United States Patent [19]

Hart et al.

[11] Patent Number: 4,763,711

[45] Date of Patent: Aug. 16, 1988

[54] FIRE DAMPER

[75] Inventors: Andrew J. Hart, Downsview; Michael T. Nailor, Toronto, both of Canada

[73] Assignee: Nailor-Hart Industries Inc., Toronto, Canada

[21] Appl. No.: 870,559

[22] Filed: Jun. 4, 1986

[51] Int. Cl.[4] ..... E05F 15/20

[52] U.S. Cl. ..... 160/1; 16/48.5; 98/1; 160/6

[58] Field of Search ..... 98/1, 40.06, 42.03, 98/42.15; 137/74, 75; 160/1, 5, 6, 84 R, 235; 16/48.5

[56] References Cited

U.S. PATENT DOCUMENTS

| | | | |
|---|---|---|---|
| 3,467,163 | 9/1969 | Vassaux | 160/1 |
| 3,687,185 | 8/1972 | Singer | 160/1 |
| 3,734,114 | 5/1973 | Phillips | 160/1 |
| 3,796,248 | 3/1974 | McCabe | 160/1 |
| 4,292,707 | 10/1981 | Williams | 16/48.5 |
| 4,333,392 | 6/1982 | Nailor et al. | 98/1 |

FOREIGN PATENT DOCUMENTS

| | | | |
|---|---|---|---|
| 1189881 | 4/1970 | United Kingdom | 160/1 |
| 1549782 | 8/1979 | United Kingdom | 160/1 |
| 1549781 | 8/1979 | United Kingdom | 160/1 |

*Primary Examiner*—Harold Joyce

*Attorney, Agent, or Firm*—Rogers, Bereskin & Parr

[57] ABSTRACT

A fire damper having a temperature-sensitive link assembly designed to permit ease of maintenance of the damper. In one embodiment, the link assembly includes a fusible link that extends across and holds the blades folded. At each end, the link is coupled to a bracket embracing the blades by a pivot pin and an associated latch that is manually releaseable. During maintenance of the damper, either latch can be released and the link will then swing down about the pivot pin at the opposite end of the link, permitting the damper blades to close. In normal use, the blades will also close in response to an over-temperature condition causing the fusible link to break. In an alternative embodiment, a plain non-fusible link is used and one of the latches is released by a temperature-sensitive actuator made of memory metal.

16 Claims, 4 Drawing Sheets

80
78
82
77
76
84

88
86
60
56
58
96'
94'
68
68a
104'
106'
102'
74
78
82
100'
98'
90'
B
92'
3
3
80
76
72
70
66
66b
66a
A
98
90
92
A
100
102
106
104
96
94

FIRE DAMPER

FIELD OF THE INVENTION

This invention relates to fire dampers used in air ducts to prevent transmission of smoke, flames and hot gases in the event of a fire.

BACKGROUND OF THE INVENTION

A typical fire damper includes a rectangular frame sized to fit closely within the duct, and a series of fire-resistant blades that are carried by the frame and pivotally coupled to one another so that they can adopt either a folded configuration at one side of the frame for normal air flow along the duct, or an extended configuration in which the blades form a curtain extending across and closing the duct in the event of fire. The blades are spring-biassed towards this extended configuration but are normally held folded by a fusible link assembly which melts and releases the blades when exposed to a predetermined elevated temperature.

The term "fire damper" as used in this application is intended to denote any damper of the general type described, which closes automatically in response to a predetermined elevated temperature.

Fire dampers of the general type described have been used satisfactorily for many years. For example, reference may be had to the present applicants' own U.S. Pat. No. 4,333,392 issued June 8, 1982. However, these types of dampers have generally been designed for one-time operation only and cannot conveniently be operated periodically for testing purposes. Many building codes now require that each fire damper in a building be examined and operated once a year to check that the damper is in operable condition. It is now considered that this procedure is important for all installations but is especially critical in schools, hospitals and nursing homes.

DESCRIPTION OF THE PRIOR ART

In existing fire dampers, the fusible link is normally incorporated in a strap that is essentially wrapped around the folded assembly of blades and is attached back to the frame at opposite sides of the blade assembly. The strap is normally made in two parts connected by a hook and eye. As such, it is theoretically possible, though inconvenient, to test the operation of the damper. This involves manually compressing the assembly of folded blades against the biassing effect of the two quite powerful blade closing springs, to at least partially relieve the tension in the strap. While holding the blades compressed with one hand, the two parts of the strap must then be unhooked from one another and allowed to fall clear before the blades can be released to close under the effect of their spring biassing. Resetting the damper then requires the blades to be refolded against the effect of the blade closing springs and the two parts of the strap to be re-engaged while the blades are held folded. When it is considered that the fire damper will be installed in an air duct and that the operations just described will probably have to be performed by a technician whose only access to the damper is through a small access door in the duct, it will be realized that periodic testing of this type of existing type of damper is practically almost impossible and as such is often ignored, in contravention of building codes.

BRIEF DESCRIPTION OF THE INVENTION

With this background in mind, the object of the present invention is to provide improvements designed to greatly facilitate periodic testing of a fire damper.

The damper provided by the invention includes a rectangular frame for installation in an air duct and having four sides surrounding a central opening, and a series of blades carried by the frame and pivotally coupled to one another for movement between a folded configuration at a side of the frame, permitting normal air flow through said opening, and an extended configuration in which the blades close said opening. Means is provided for biassing the blades towards and having holding the blades in the said extended configuration. A temperature-sensitive link assembly is carried by the frame and is arranged to normally maintain the blades in their said folded configuration but is adapted to release the blades for movement to their extended configuration in response to a predetermined elevated temperature. The assembly includes a link that extends through the frame opening across the folded blades for holding the blades against movement towards their extended configuration, first and second brackets extending outwardly from the frame for co-operation with respective end portions of the link, and respective coupling means between each bracket and the associated end portion of the link. At least one of the coupling means comprises a latch releasably retaining the link at one end while the other coupling means defines, at the opposite end of the link, a pivot axis oriented to permit the link to swing clear of the blades when said latch has been operated, for testing the damper, said latch and link being reengageable for resetting the damper.

It will be appreciated that this type of damper can readily be tested by merely reaching into the duct and operating the latch. The link will swing clear of the blades as the blades are moved towards their extended configuration. Operation of the latch will abruptly release the blades in a manner simulating much more closely the release conditions that will occur in a fire, as compared with the release conditions simulated when a conventional fire damper is tested as described above. In other words, not only is the testing operation made more convenient but actual fire conditions are more closely simulated.

Preferably, the coupling means at both ends of the link will each include a latch and define a pivot axis about which the link can pivot when the latch at the opposite end of the link has been released. This allows the damper to be operated from either side, which is an important practical consideration permitting the damper to be installed without regard for the need to assure access to a particular side of the damper after installation.

The temperature-sensitive link assembly may incorporate a fusable link or a temperature-sensitive actuator may be employed to release the link, as will be described.

BRIEF DESCRIPTION OF THE DRAWINGS

In order that the invention may be more clearly understood, reference will now be made to the accompanying drawings which illustrate a preferred embodiment of the invention by way of example, and in which.

DESCRIPTION OF THE PREFERRED EMBODIMENT

Figure 1:
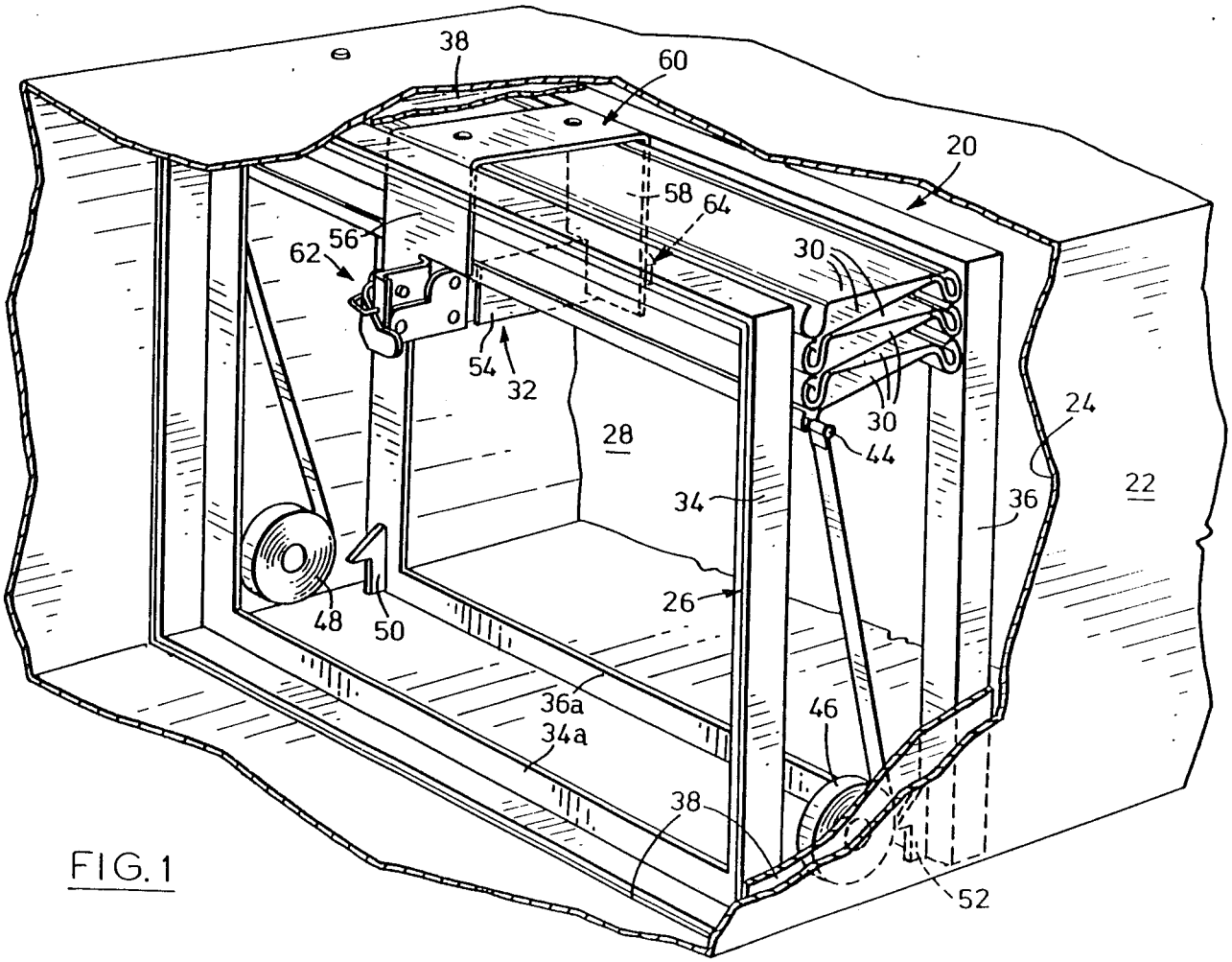
FIG. 1 is a somewhat diagrammatic illustration of a fire damper installed in an air duct, with part of the air duct boken away.

Referring first to FIG. 1, a fire damper generally indicated by reference numeral 20 is shown installed in an air duct 22 that has been partially broken away as indicated at 24, to show the damper. The damper itself has a rectangular frame 26, the four sides of which surround a central opening 28 through which air normally flows along the duct.

Figure 5:
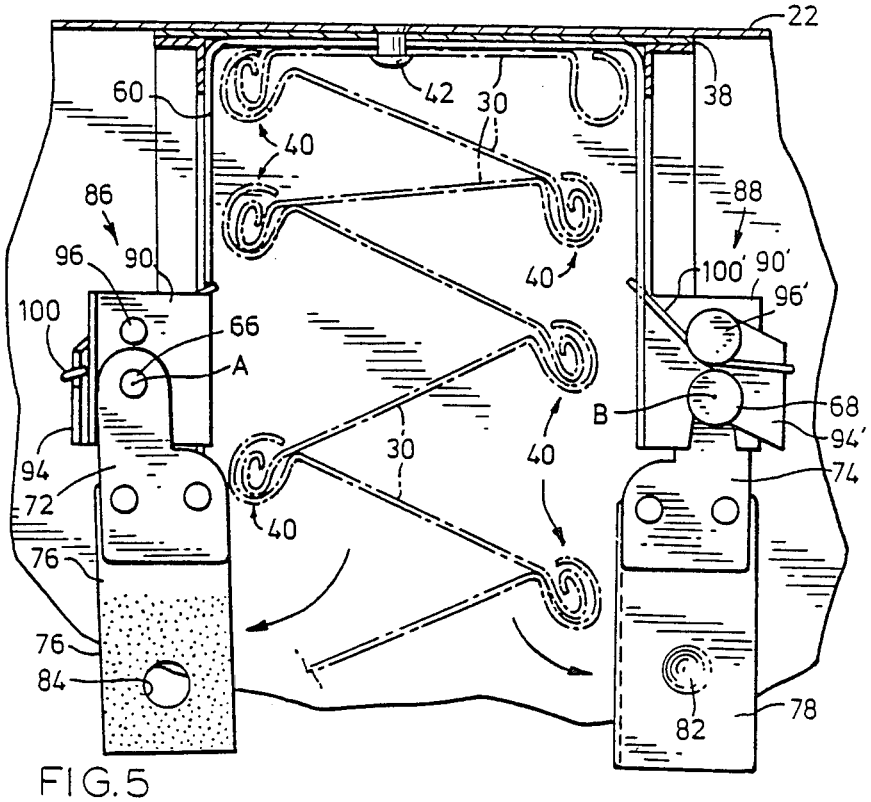

A series of steel blades individually denoted 30 are carried by the frame and are pivotally coupled to one another for movement between a folded configuration at a side of the frame (in this case the top side) and an extended configuration in which the blades close the opening 28. FIG. 1 shows the blades in their normal folded configuration while FIG. 5 shows the blades extended. A temperature-sensitive link assembly 32 normally retains the blades in their folded configuration as will be described.

The blades 30 are located between a pair of spaced subframes 34 and 36 at opposite ends of the damper. These subframes form part of the damper frame proper (26) and are joined by a sheet metal outer skin 38 which has been partly broken away in FIG. 1. As can be seen, each of the subframes 34, 36 is of angle-shape in cross-section and the subframes face outwardly with respect to one another so that their inner flanges 34*a*, 36*a* respectively in effect define a track within which the blades 30 can move. The blades themselves are essentially rectangular galvinized steel plates with opposite longitudinal margins roll-formed to permit the blades to pivotally interlock as perhaps best seen in Figs. 4 and 5. The interlocking portions of the blades in effect form hinges generally denoted by reference numeral 40 in those views. It can be seen there that the uppermost blade 30 is rivetted to the frame of the fire damper as indicated at 42. Secured along the outer edge of the outermost blade 30 is a rod 44 (FIGS. 4 and 1) that projects from the ends of the blade as best seen in FIG. 1.

Referring back to that view, a pair of coil springs 46 and 48 carried by frame 26 are secured at their outer ends to the projecting end portions of rod 44. These springs bias the blades 30 towards their extended configuration so that, when the link assembly 32 is released, the blades will be drawn downwardly almost instaneously. The blades are then locked in place by engagement of the end portions of rod 44 in respective latch plates 50 and 52 carried by frame 26. In this position, the blades effectively form a complete fireproof curtain across the damper. The interlocking marginal portions of the blades effectively avoid gaps that might otherwise permit transmission of smoke or gases through the damper. At the same time, the blades fit closely within frame 26, preventing gas flow around the blades.

It should at this stage be noted that the damper as thus far described is essentially known except for the temperature-sensitive link assembly 32. Reference may be had to applicant's U.S. Pat. No. 4,333,392 for further details of the construction of the frame, blades or springs. The disclosure of that patent is incorporated herein by reference.

As indicated previously, link assembly 32 is arranged to normally maintain the blades in their folded configuration shown in FIG. 1 but is also adapted to release the blades for movement to their extended configuration in response to a predetermined temperature indicating a fire. In addition, the assembly can be manually operated to release the blades for testing purposes.

Figures 2, 3:
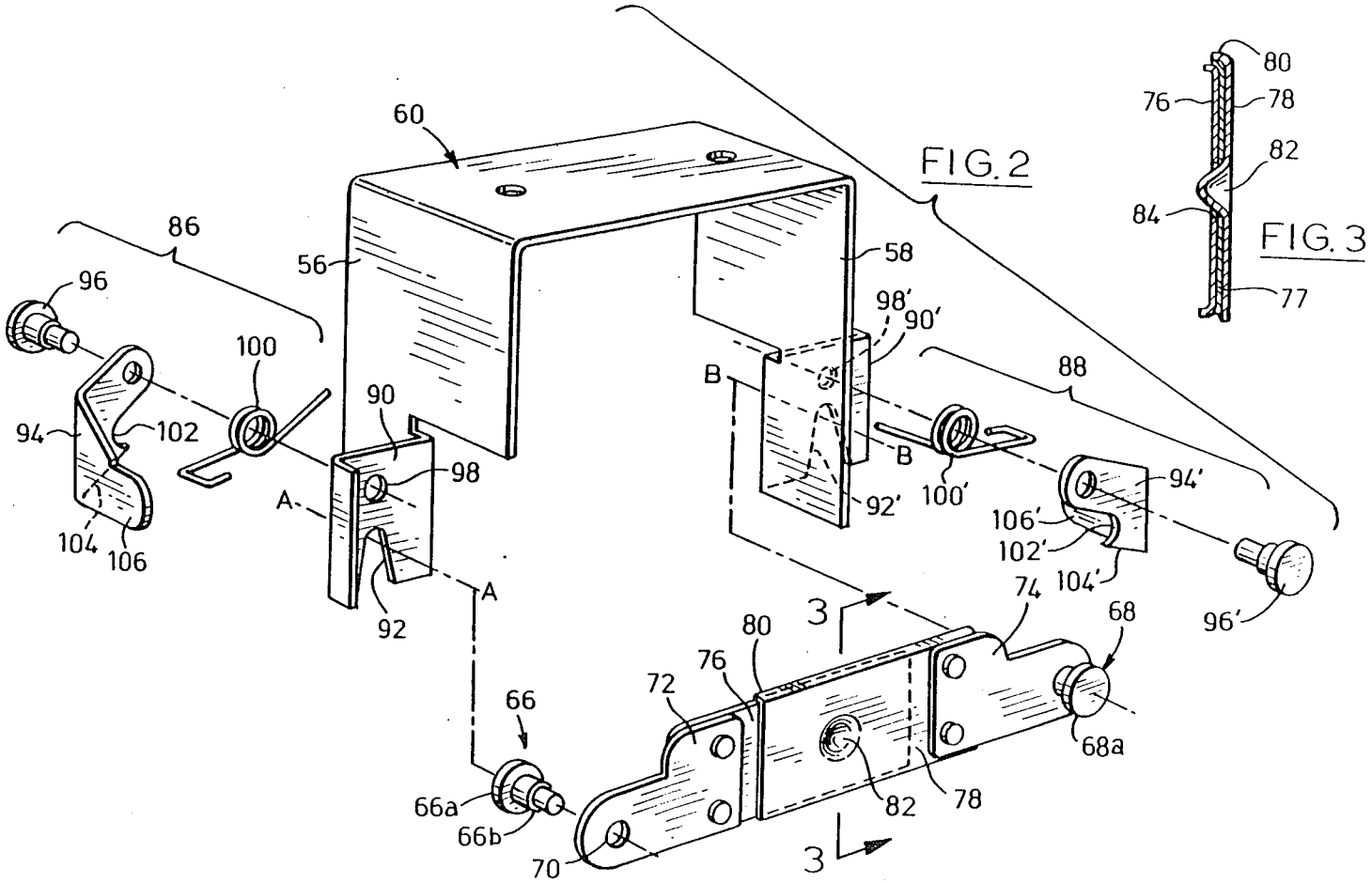
FIG. 2 is an exploded perspective view of the temperature-sensitive link assembly of the fire damper.
FIG. 3 is a sectional view on line 3—3 of FIG. 2.

As best seen in FIG. 1, the link assembly 32 includes a fusible link 54 that extends through the frame opening 28 across the folded blades for holding the blades against movement towards their extended configuration. First and second brackets 56, 58 extend outwardly from the frame for co-operation with respective end portions of the link 54. In the particular embodiment illustrated, the two brackets 56 and 58 are in fact formed by portions of a single bracket of inverted U-shape as best seen in FIG. 2 and denoted by reference numeral 60. FIG. 1 shows that the bracket 60 is fitted between the two subframes 34 and 36 of frame 26 so as to in effect embrace the assembly of blades 30 with the limbs forming the brackets 56 and 58 on respectively opposite sides of and projecting below the blades. Respective coupling means indicated at 62 and 64 in FIG. 1 are provided between each of the brackets 56 and 58 and the associated end portion of the fusible link 54. In this embodiment, each of these coupling means includes a manually operable latch by which the link can be released from the bracket. Each latch is also designed to provide a pivot axis between the link and bracket so that the link can swing clear of the blades 30, as will now be described primarily with reference to FIG. 2.

It can be seen from that view that the link 54 is provided at its ends with respective pivot pins 66 and 68, each of which is received in an opening in an end plate of link 54, as for example the opening 70 in plate 72 receiving pin 66. The other pin 68 is essentially the same and is secured to a plate 74 of link 54. Referring to pin 66, it will be seen that the pin has an enlarged head 66*a* and a stem having an outer end portion 66*b* of reduced diameter that fits in opening 70. In manufacture, the pin is fitted into the opening and the end of the pin is then upset in the manner of a rivet to secure the pin to the link.

The respective plates 72 and 74 are in turn rivetted to respective inner plates 76 and 78 that are secured together in surface-to-surface contact by solder. A flange 80 along the top edge of plate 78 and a depression 82 in plate 78 mating with a corresponding opening 84 in plate 76 (see FIG. 5) assure proper relative location between the two plates 76, 78 in manufacture of the link.

Each of the pivot pins 66, 68 is coupled to the associated bracket 56 or 58 by a manually operable latch that releasably retains the pivot pin while at the same time allowing the link 54 to pivot about that pin and swing aside in the event that the latch at the opposite end of the link is released. The two latches are generally denoted 86 and 88 in FIGS. 2 to 5 but are essentially identical. Accordingly, for convenience of description, the components of latch 86 only will now be described primarily with reference to FIG. 2; corresponding components of latch 88 will be denoted by primed reference numerals.

Bracket 56 is formed to provide an outwardly protruding ear or lug 90 formed with a slot 92 which opens into the lower edge of the lug and is dimensioned to receive the stem of pivot pin 66. A latch member 94 is pivotally coupled to lug 90 by a pivot pin 96 that is rivetted at its outer end into an opening 98 in ear 90. A coil spring 100 is fitted to the pivot pin 96 between the latch member 94 and ear 90 and acts between the bracket 56 and the latch member 94 to maintain the latch member in an operative position in which it holds the pivot pin 66 of the fusible link 54 in slot 92. To this end, the latch member is shaped to provide a seat 102 that engages around the pivot pin 66. An integral, protuberant tab or ear 106 on latch member 94 provides a finger grip by which the latch member can be pivoted about its pin 96 to release the pivot pin 66 of the fusible link 54 when the fire damper is to be tested.

Immediately below the seat 102 of latch member 94, is an inclined surface 104 that in effect acts as a cam surface for resetting the fusible link assembly. Thus, if it is assumed that the latch member 94 is in its normal operative position in effect closing the bottom of slot 96 but pivot pin 96 is not in position in the slot, then the latch member 94 can be deflected by urging pivot pin 66 upwardly along surface 104 so that the pivot pin will then seat fully within slot 92 and latch member 94 will snap into place behind the pivot pin.

When the pivot pin 66 is in place in slot 92 and is held by latch member 94, then the pin provides a pivot axis A—A about which the fusible link 54 can pivot if latch 88 is released. Pivot pin 68 provides a similar pivot axis B—B about which the link can also pivot if latch 86 is released.

Figure 4:
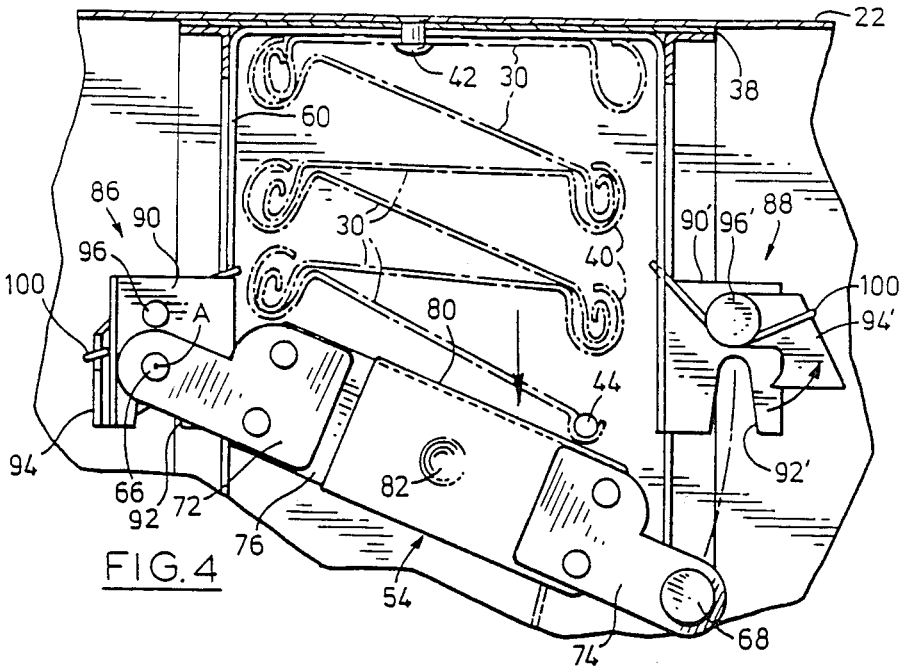
FIGS. 4 and 5 are elevational views illustrating the manner in which the link assembly is operated when testing the damper.

FIGS. 4 and 5 illustrate the two alternative methods by which the fusible link assembly can be released. As seen in FIG. 4, it is assumed that latch 88 has been released by manually deflecting its latch member 94' in the direction of the arrow in FIG. 4, releasing pivot pin 68 from within slot 92'. The fusible link 54 can then swing aside by pivoting about the axis A of the pivot pin 66 at the opposite end of the link as shown so that the blades 30 are released to move to their extended configuration.

In this way, the operation of the damper can be tested without destructively affecting the fusible link 54. To reset the damper, the blades are manually refolded and the fusible link is pivoted in the reverse direction to bring the pivot pin 68 back into slot 92'. As described previously, pivot pin 68 will automatically deflect latch member 94' as it enters the slot 92' and the latch member will automatically snap back below the pin and hold the pin in the slot. The link can also be released from the other end by operating latch 94 as discussed previously and can be reset in the same way.

FIG. 5 illustrates release of the blades due to an over-temperature condition detected by the fusible link 54. Thus, if the link is exposed to a temperature equal to or above the melting temperature of the solder that joins the two plates 76, 78 of the fusible link, the solder will melt and the two plates will separate as shown in FIG. 5. The two parts of the link will then pivot aside about the respective pivot axes A and B, allowing the blades 30 to be drawn down into the "damper-closed" position. Of course, it is not intended that the link will be reused after it is broken in this way. If the damper is to be reset, a new link must be used. It will, however, be understood that the new link can be readily installed simply by pressing it up into the two latches 86, 88 after the blades 30 have been folded.

In summary, the fusible link assembly not only allows the damper to operate in its normal fashion in response to an over-temperature condition (FIG. 5) but permits the damper to be easily tested in situ simply by release whichever of the two latches, 86, 88 happens to be most convenient to the testing technician. After testing, the damper can be quite easily reset by folding the blades and restoring the fusible link to its position in which it is retained by both latches.

Figure 6:
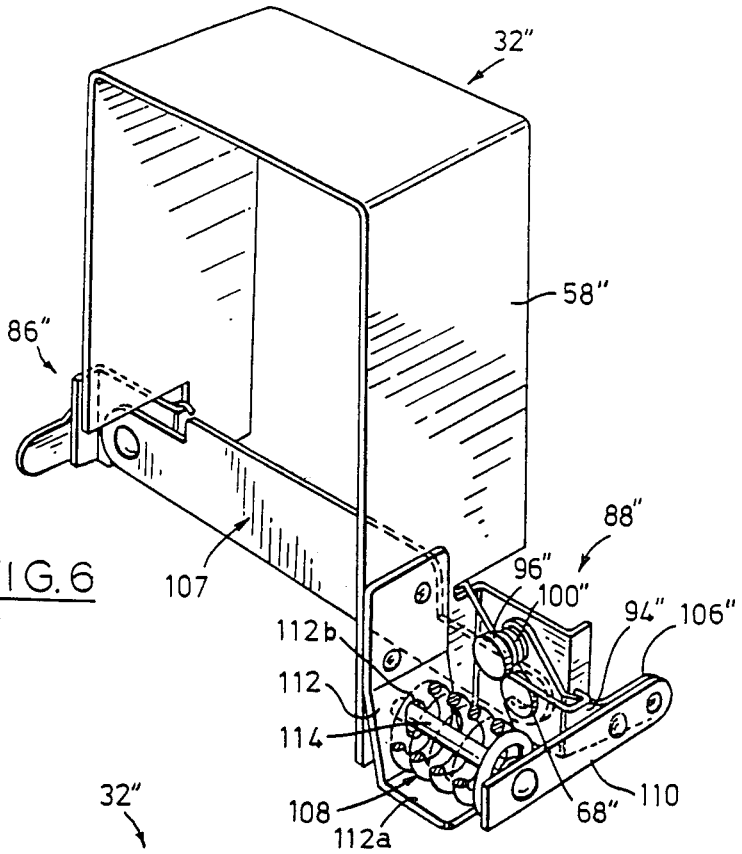
FIG. 6 is a perspective view of a link assembly according to a further embodiment of the invention; and, FIG. 7 is a view similar to FIG. 4 illustrating release of the link assembly of FIG. 6 under fire conditions.
Figure 7:
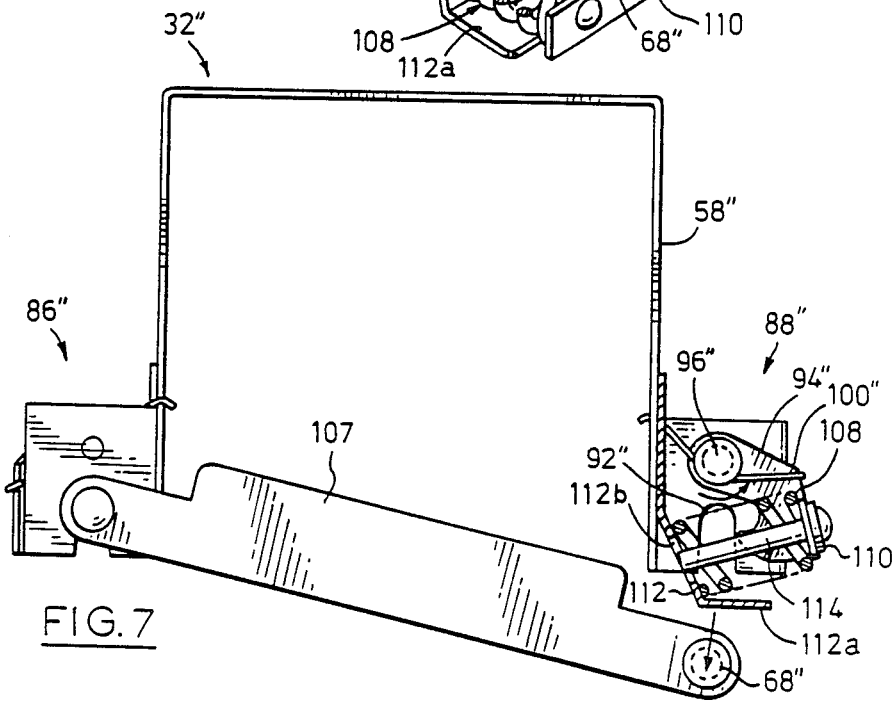

Reference will now be made to FIGS. 6 and 7 in describing an alternative embodiment of the invention. In those views, double primed reference numerals will be used to denote parts corresponding to parts shown in previous views.

FIGS. 6 and 7 show a temperature-sensitive link assembly 32'' that differs from the assembly shown in the previous views in that the fusible link assembly 54 previously described has been replaced by a plain steel link 106 and in that the assembly includes a temperature sensitive actuator 108 designed to release the latch 88'' at a predetermined elevated temperature, for actuating the damper. In other words, instead of employing a fusible link that in effect breaks at an elevated temperature, in the embodiment of FIGS. 6 and 7, one of the two latches at the ends of the link of the assembly (in this case latch 88'') is released by a temperature-sensitive actuator. The link 107 then pivots downwardly about the pivot axis of latch 86'' essentially as shown in FIG. 4 just as if latch 88'' had been manually released.

In this particular embodiment, actuator 108 takes the form of a coil of an alloy of so-called "memory metal" having the characteristic that the metal undergoes a change in shape in response to increase in temperature but will return to its original shape upon cooling assuming the maximum temperature reached does not exceed the annealing point of the metal. Alloys having this characteristic are well known and are referred to as "memory metals". An example is sold under the trade mark NITINOL (an alloy of nickel and titanium). In this particular embodiment, the actuator 108 is made of a copper/tin alloy. By suitable adjustments to the composition of the alloy, the alloy can be arranged to have a transition point (the point at which the change in shape occurs) that corresponds with the temperature rating of standard fusible links (e.g. 165° F. to 286° F.—74° C. to 141° C.).

In this embodiment, a coil is formed of this alloy and is arranged to act between the latch member 94'' of latch 88'' and the bracket 58'' of the link assembly 32''. Specifically, a lateral arm 110 is rivetted to the tab or ear 106'' of latch member 94'' and extends across the outer end of actuator coil 108. The inner end of the coil bears against an inclined plate 112 that is rivetted to bracket 58''. As best seen in FIG. 7, an outer end portion **112*a* of that plate is bent outwardly below coil 108 so as to assist in supporting the coil when relaxed. The coil is also located by a pin 114 that is attached to arm 110 and extends through the coil and through a slot 112*b* in plate 112**.

Due to the composition of the alloy from which coil 108 is made, when the coil is subjected to a predetermined temperature within the normal temperature range at which a standard fusible link melts, the shape of the coil will change by elongation, effectively forcing arm 110 outwardly as best shown in FIG. 7 and releasing latch member 94'' so that the pivot pin 68'' is free to fall in the manner described previously in connection with FIG. 4. In this way, the temperature-sensitive link assembly will respond to a fire condition in essentially the same way as in the embodiment previously described except in that the link 107 of FIGS. 6 and 7 will not break but will merely be released at one end. At the same time, the link can be manually released at either end by operating the relevant latch 86" or 88" as described in connection with the preceding embodiment.

In contrast to standard fusible links and the embodiment of FIGS. 1 to 5, however, the temperature-sensitive link assembly of FIGS. 6 and 7 can be reset after the high temperature condition that led to elongation of actuator coil 108 has passed. Thus, when the coil cools, it will resume its former shape, allowing latch member 94" to return to its normal position under the influence of return spring 100". The link 107 can then be re-engaged with latch 88" by simply pivotting the latch back to its normal position as described previously.

In an actual fire situation, the actuator coil 108 is likely to be exposed to a temperature that would exceed the annealing temperature of the alloy from which the coil is made and it would not be possible to subsequently reset the damper. However, the use of a "memory metal" actuator coil does have significant advantages. First, if the damper is exposed to an abnormal transient or "flash" high temperature situation in which the coil actuates the damper and allows it to close, the damper can be subsequently set as described previously. This situation might occur, for example, where a fire breaks out at a location remote from the damper. Secondly, the damper can be tested for operation not only by manually tripping one of the latches 86" or 88" but also by heating the coil 108 for example using an industrial hair dryer. In other words a temperature-sensitive link assembly of the type shown in FIGS. 6 and 7 can be tested not only by manual triggering but also by triggering using heat. In either event, the damper can then be reset.

It will of course be appreciated that the preceding description relates to particular preferred embodiments of the invention only and that many modifications are possible within the broad scope of the invention. For example, in either embodiment, latches are provided at both ends of the link, and each of these latches provides a pivot axis for the link. While two latches are believed to desirable for most practical applications, there may be situations in which this is unnecessary in which case only a single latch need be provided for one end of the link while the other end would be simply pivotally coupled to the relevant bracket.

It should also be noted that temperature-sensitive link assemblies of the form provided by the invention may be made available for installation on existing dampers, in place of the fusible link normally provided.

It will also be understood that a fusible link other than of the form specifically described above may be used in the embodiment of FIGS. 1 to 5. For example, the link could be formed by two plates similar to the plates 72 and 74 described above but connected together by a single bar or slug of a material that will melt at the required elevated temperature.

In the embodiments of FIGS. 6 and 7, the heat responsive actuator 108 may be other than of the form specifically illustrated. For example, a U-shaped actuator acting between the latch and the bracket 58" may be feasible. Also, the latch associated with the actuator need not be manually operable although this is clearly preferred in order that the link may be released from either end. Also, actuators could be provided in association with both latches.

We claim:

1. A fire damper comprising:

a rectangular frame for installation in an air duct and having four sides surrounding a central opening;

a series of blades carried by the frame and pivotally coupled to one another for movement between a folded configuration at a side of the frame permitting normal air flow through said opening, and an extended configuration in which the blades close said opening;

means biassing the blades towards and for holding the blades in said extended configuration; and, a temperature-sensitive link assembly carried by said frame and arranged to normally maintain the blades in said folded configuration, but adapted to release the blades for movement to said extended configuration in response to a predetermined elevated temperature, said assembly including: a link extending through said frame opening across the folded blades for holding the blades against movement towards said extended configuration; first and second brackets extending outwardly from the frame for co-operation with respective end portions of said link; and respective coupling means between each said bracket and the associated end portion of the link, each said coupling means comprising a latch member pivotally coupled to the relevant one of said first and second brackets, and a pivot pin on said link, said bracket including an open-ended slot receiving said pivot pin and said latch member defining a seat for retaining the pivot pin in said slot, the latch member being movable between a latched position in which the pivot pin is held within the slot, and an unlatched position in which the pivot pin is released, permitting the link to swing clear of the blades.

2. A fire damper as claimed in claim 1, wherein said link is a fusible link comprising first and second parts each including a plate, the plates of the respective parts being soldered together face-to-face, whereby the link will break and release the blades when exposed to a temperature at least equal to the melting point of the solder.

3. A fire damper as claimed in claim 2, wherein one of said plates has a rectilinear edge formed with a lip against which a corresponding edge of the other plate is located, and wherein one of said plates includes a projection received in an opening in the other plate, whereby the plates are maintained in co-operating relationship with respect to one another in manufacture.

4. A fire damper as claimed in claim 1, wherein each said latch further includes spring means biassing said latch member to its latched position and wherein each said latch member has a cam surface for co-operation with the associated pivot pin, said surface being arranged so that the latch member is deflected from its latched position towards its unlatched position in response to movement of the pivot pin into said slot upon resetting of the fire damper.

5. A fire damper as claimed in claim 1, wherein said first and second brackets of the temperature-sensitive link assembly are formed by side limbs of a bracket member of inverted U-shape coupled to said frame with the limbs of the member extending outwardly from the frame on opposite sides of the blades.

6. A fire damper as claimed in claim 1, wherein said link assembly includes temperature-sensitive actuator means adapted to release one of said latch members at a predetermined elevated temperature and to restore the latch member to its normal link retaining position upon cooling, whereby the damper can be reset after exposure to a transient high temperature situation.

7. A fire damper as claimed in claim 6, wherein said temperature-sensitive actuator acts between said latch member and bracket and is made of a memory metal selected to cause elongation of the effective length of the actuator and release of said latch member upon exposure of the actuator to a predetermined elevated temperature, the metal permitting restoration of the actuator to its former length upon cooling for restoring the latch member to its normal link-retaining position.

8. A fire damper as claimed in claim 7, wherein said actuator is formed in the shape of a coil, the effective length of which increases while exposure of the coil to said predetermined elevated temperature.

9. A temperature-sensitive link assembly for a fire damper, comprising a bracket member of generally inverted U-shape having side limbs defining respective first and second brackets for embracing a folded assembly of fire damper blades, a link extending between said first and second brackets and having opposite end portions for co-operation with respective ones of said brackets, and respective coupling means between each said bracket and the associated end portion of the link, at least one of said coupling means comprising a latch member pivotally coupled to the relevant one of said first and second brackets, and a pivot pin on said link, said bracket including an open-ended slot receiving said pivot pin and said latch member defining a seat for retaining the pivot pin in said slot, the latch member being movable between a latched position in which the pivot pin is held within the slot, and an unlatched position in which the pivot pin is released, and said link assembly being responsive to a predetermined elevated temperature for automatically releasing the blades at said temperature.

10. A temperature-sensitive link assembly as claimed in claim 9, including temperature-sensitive actuator means adapted to release one of said latch member at a predetermined elevated temperature and to restore the latch to its normal link retaining position upon cooling, whereby the damper can be reset after exposure to a transient high temperature situation.

11. A temperature-sensitive link assembly as claimed in claim 9, wherein said temperature-sensitive actuator acts between said latch member and bracket and is made of a memory metal selected to cause elongation of the effective length of the actuator and release of said latch upon exposure of the actuator to a predetermined elevated temperature, the metal permitting restoration of the actuator to its former length upon cooling for restoring the latch to its normal link-retaining position.

12. A temperature-sensitive link assembly as claimed in claim 9, wherein said actuator is formed in the shape of a coil, the effective length of which increases while exposure of the coil to said predetermined elevated temperature.

13. A fire damper comprising:

a rectangular frame for installation in an air duct and having four sides surrounding a central opening;

a series of blades carried by the frame and pivotally coupled to one another for movement between a folded configuration at a side of the frame permitting normal air flow through said opening, and an extended configuration in which the blades close said opening;

means biassing the blades towards and for holding the blades in said extended configuration; and, a temperature-sensitive link assembly carried by said frame and arranged to normally maintain the blades in said folded configuration, but adapted to release the blades for movement to said extended configuration in response to a predetermined elevated temperature, said assembly including: a link extending through said frame opening across the folded blades for holding the blades against movement towards said extended configuration; first and second brackets extending outwardly from the frame for co-operation with respective end portions of said link; and respective coupling means between each said bracket and the associated end portion of the link, at least one of said coupling means comprising a latch releasably retaining the link at one end, while the other coupling means defines at the opposite end of the link, a pivot axis oriented to permit the link to swing clear of the blades when the said latch has been released, for testing the damper, said latch and link being re-engageable for resetting the damper;

wherein said link is a fusible link comprising first and second parts each including a plate, the plates of the respective parts being soldered together face-to-face, so that the link will break and release the blades when exposed to a temperature at least equal to the melting point of the solder, one of the plates having a rectilinear edge formed with a lip against which a corresponding edge of the other plate is located, and one of the plates including a projection received in an opening in the other plate for maintaining the plates in co-operating relationship with respect to one another in manufacture.

14. A fire damper as claimed in claim 13, wherein said fusible link further includes respective pivot pins coupled to said plates outwardly of areas of said plates which are soldered together, the pivot pins defining respective pivot axes which are parallel to one another, and wherein each said coupling means of the temperature sensitive link assembly includes a latch engageable with the relevant one of said pivot pins of the fusible link for releasably retaining the link at the relevant end, the latch permitting pivoting of the link about the relevant pivot pin when the latch at the opposite end of the link has been released.

15. A fire damper as claimed in claim 14, wherein each said latch comprises a latch member pivotally coupled to one of the first and second brackets of the temperature sensitive link assembly, said bracket including an open-ended slot receiving said pivot pin and said latch member defining a seat for retaining the pivot pin in said slot, the latch member being movable between a latched position in which the pivot pin is held within the slot, and an unlatched position in which the pivot pin is released for release of the link.

16. A fire damper as claimed in claim 15, wherein each said latch further includes spring means biassing said latch member to its latched position and wherein each said latch member has a cam surface for co-operation with the associated pivot pin, said surface being arranged so that the latch member is deflected from its latched position towards its unlatched position in response to movement of the pivot pin into said slot upon resetting of the fire damper.

* * * * *